US005938564A

United States Patent [19]

Bachman

[11] Patent Number: 5,938,564

[45] Date of Patent: Aug. 17, 1999

[54] TRACK RUNNER PACING DEVICE

[76] Inventor: Ron G. Bachman, R.R. #1 Box 136, Lowpoint, Ill. 61545

[21] Appl. No.: 09/016,961

[22] Filed: Feb. 2, 1998

[51] Int. Cl.[6] ..... A63K 1/00

[52] U.S. Cl. ..... 482/3; 472/87; 472/85; 482/74

[58] Field of Search ..... 482/1–9, 14, 15, 482/19, 54, 74, 148, 901, 902; 472/85, 87

[56] References Cited

U.S. PATENT DOCUMENTS 1,965,287 7/1934 Heintz ..... 472/87

1,973,927 9/1934 Motley ..... 472/87

2,002,427 5/1935 Bacon ..... 472/87

4,280,694 7/1981 Trickel ..... 472/87

*Primary Examiner*—Glen E. Richman

[57] ABSTRACT

A track runner pacing device is provided including a running track. A pacer housing is adapted to move around the running track. A control mechanism serves to effect the movement of the pacer housing about the track at a speed calculated from a distance and time entered into the control means by a user.

1 Claim, 3 Drawing Sheets

TRACK RUNNER PACING DEVICE

BACKGROUND OF THE INVENTION

1. Field of the Invention

The present invention relates to a track runner pacing device and more particularly pertains to aiding a track runner during practice.

2. Description of the Prior Art

The use of dog track rabbit lures is known in the prior art. More specifically, dog track rabbit lures heretofore devised and utilized for the purpose of luring dogs during a race are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,070,016; U.S. Pat. No. 4,280,694; U.S. Pat. No. 4,228,998; U.S. Pat. No. 5,138,550; U.S. Pat. No. 4,619,222; and U.S. Pat. No. Des. 325,758.

In this respect, the track runner pacing device according to the present invention substantially departs from the conventional concepts and designs of the prior art, and in so doing provides an apparatus primarily developed for the purpose of aiding a track runner during practice.

Therefore, it can be appreciated that there exists a continuing need for a new and improved track runner pacing device which can be used for aiding a track runner during practice. In this regard, the present invention substantially fulfills this need.

SUMMARY OF THE INVENTION

In view of the foregoing disadvantages inherent in the known types of dog track rabbit lures now present in the prior art, the present invention provides an improved track runner pacing device. As such, the general purpose of the present invention, which will be described subsequently in greater detail, is to provide a new and improved track runner pacing device which has all the advantages of the prior art and none of the disadvantages.

To attain this, the present invention essentially comprises a running track having a generally oval configuration. Note FIG. 2. An inner periphery and an outer periphery of the running track are each equipped with an upwardly extending lip of a constant height formed along an entire length thereof. Each lip has a top edge and a planar inner and outer surface. Next provided is a pacer housing including a top extent having a planar bottom face, a tapered front face, a tapered rear face, and a pair of tapered side faces formed therebetween defining an interior space. See FIG. 5. The pacer housing further includes a bottom extent having a pair of guides integrally coupled to the bottom face of the top extent adjacent to the side faces thereof and extending downwardly therefrom. Such guides define a vertically oriented slot. The guides each have a planar inner surface with a plurality of free rollers rotatably mounted thereto about vertical axes. The rollers extend inwardly for abutting the inner and outer surfaces of the lip of the track when the slot of the pacer housing is positioned thereon. This allows the pacer housing to glide freely along the lip. Mounted to the top extent of the pacer housing and extended upwardly therefrom is a flag. The flag is adapted for identifying the pacer housing. As shown in FIG. 5, a drive unit includes a motor situated within the interior space of the top extent of the pacer housing. The motor is rotatably engaged with a drive wheel which is mounted about a horizontal axis. The drive wheel depends downwardly from the bottom face of the top extent of the pacer housing thereby abutting the top edge of the lip of the track during use. During use, the motor is adapted to rotate the drive wheel and effect the forward movement thereof along the lip only upon the receipt of a speed signal. It should be understood that a speed of the pacer housing corresponds with that which is transmitted with the speed signal. As shown in FIGS. 1 & 4, a control panel is positioned on one of the side faces of the top extent of the pacer housing. The control panel includes a lid hingably coupled along a top edge thereof and pivotable between a raised and lowered orientation. The lid thus allows selective access to the control panel. The control panel further includes a digital display for depicting a number upon the receipt thereof. A numeric keypad includes a plurality of numeric buttons. Associated therewith is a plurality of control buttons including a distance button for allowing a user to enter a number via the numeric keypad representative of a distance. The control buttons further include a time button for allowing a user to enter a number via the numeric keypad representative of a time. Lastly, a rest button serves to permit a user to enter a number via the numeric keypad representative of a rest period. It should be understood the numbers are displayed on the digital display upon being entered. As shown in FIG. 4, an audio means is adapted for generating an audio signal only upon the actuation thereof. Connected to the display, motor, keypad, and buttons is a control means. During use, the control means transmits to the motor the speed signal only upon the entering of a distance, a time, and a rest period. Such speed signal represents a speed calculated from the distance and time. Further, the speed signal is transmitted only for the duration of the entered time. Upon the cessation of the speed signal, the control means stops the pacer housing for the entered rest period prior to repeating operation. Finally, the control means is further adapted to actuate the audio means a predetermined amount of time prior to the cessation of the rest period.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved track runner pacing device which has all the advantages of the prior art dog track rabbit lures and none of the disadvantages.

It is another object of the present invention to provide a new and improved track runner pacing device which may be easily and efficiently manufactured and marketed.

It is a further object of the present invention to provide a new and improved track runner pacing device which is of a durable and reliable construction.

An even further object of the present invention is to provide a new and improved track runner pacing device which is susceptible of a low cost of manufacture with regard to both materials and labor, and which accordingly is then susceptible of low prices of sale to the consuming public, thereby making such track runner pacing device economically available to the buying public.

Still yet another object of the present invention is to provide a new and improved track runner pacing device which provides in the apparatuses and methods of the prior art some of the advantages thereof, while simultaneously overcoming some of the disadvantages normally associated therewith.

Still another object of the present invention is to aid a track runner during practice.

Lastly, it is an object of the present invention to provide a new and improved track runner pacing device including a running track. A pacer housing is adapted to move around the running track. A control mechanism serves to effect the movement of the pacer housing about the track at a speed calculated from a distance and time entered into the control means by a user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
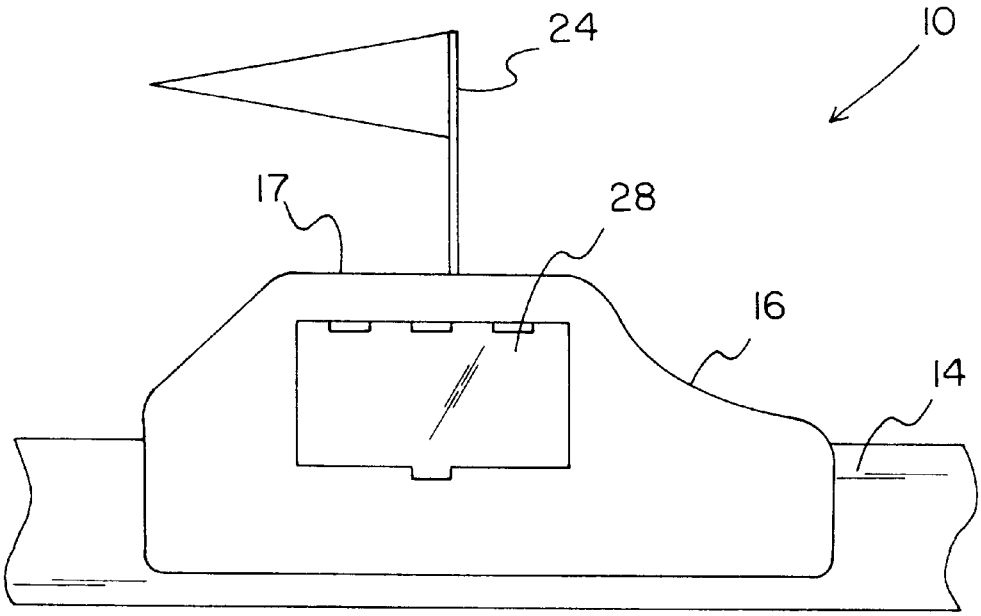
FIG. 1 is a perspective illustration of the preferred embodiment of the track runner pacing device constructed in accordance with the principles of the present invention.

With reference now to the drawings, and in particular to FIG. 1 thereof, a new and improved track runner pacing device embodying the principles and concepts of the present invention and generally designated by the reference numeral 10 will be described.

The present invention, the new and improved track runner pacing device, is comprised of a plurality of components. Such components in their broadest context include a pacer housing with a drive unit and control means. Such components are individually configured and correlated with respect to each other so as to attain the desired objective.

Figure 2:
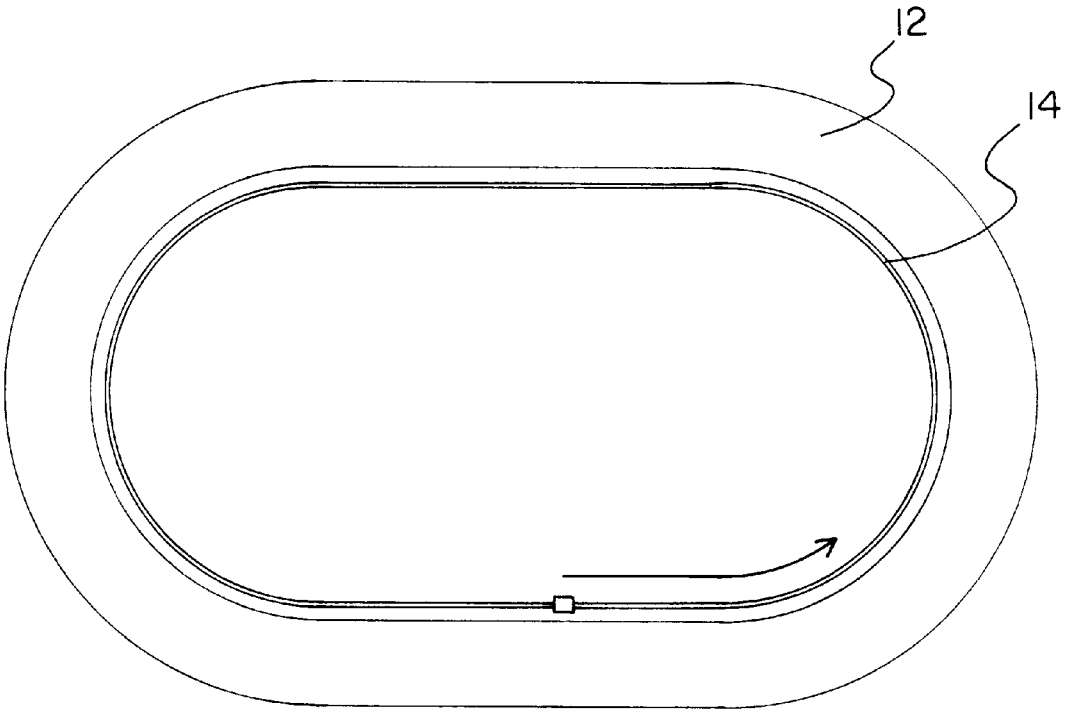
FIG. 2 is a top view of the present invention during use.
Figure 3:
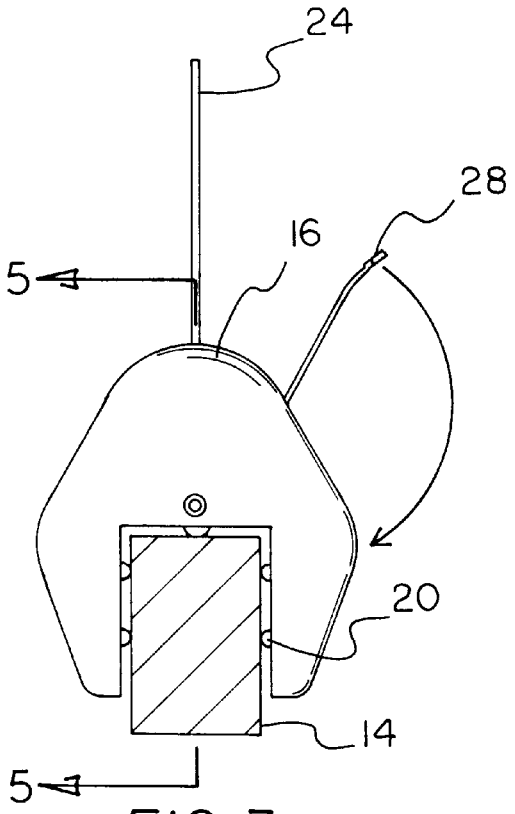
FIG. 3 is a front view of the present invention.

More specifically, it will be noted that the system 10 of the present invention includes a running track 12 having a generally oval configuration. Note FIG. 2. An inner periphery and an outer periphery of the running track are each equipped with an upwardly extending lip 14 of a constant height formed along an entire length thereof. Each lip has a top edge and a planar inner and outer surface.

Figure 5:
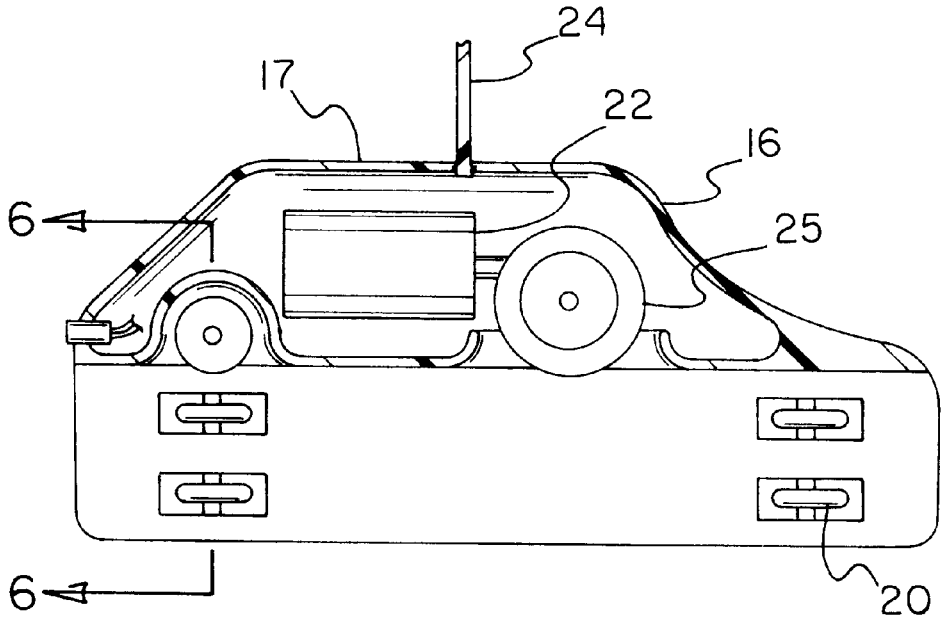
FIG. 5 is a side cross-sectional view of the present invention taken along line 5—5 shown in FIG. 3.
Figure 6:
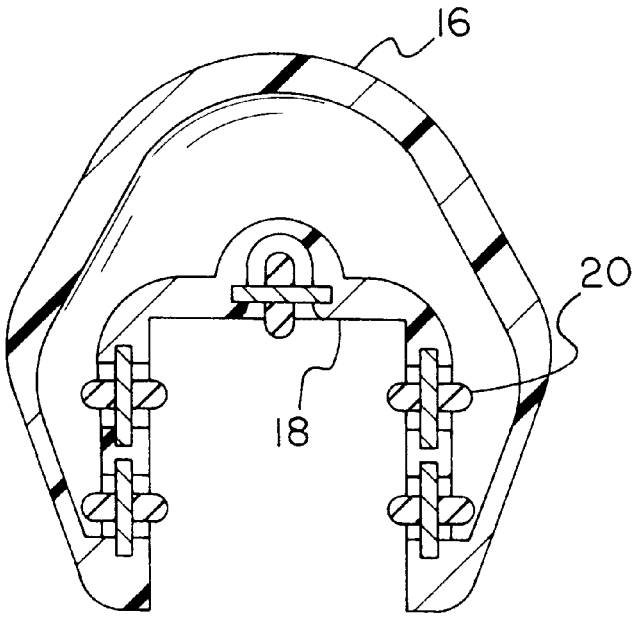
FIG. 6 is a front cross-sectional view of the present invention taken along line 6—6 shown in FIG. 5.

Next provided is a pacer housing 16 including a top extent 17 having a planar bottom face, a tapered front face, a tapered rear face, and a pair of tapered side faces formed therebetween defining an interior space. As shown in FIG. 5, the pacer housing thus resembles a miniature vehicle. Ideally, a height of the top extent is less than that of the lip. The pacer housing further includes a bottom extent 18 having a pair of guides integrally coupled to the bottom face of the top extent adjacent to the side faces thereof and extending downwardly therefrom. Such guides define a vertically oriented slot. Exterior faces of the guides preferably taper inwardly from the top extent downward.

The guides each have a planar inner surface with a plurality of free rollers 20 rotatably mounted thereon about vertical axes. In the preferred embodiment, the rollers include four paris of vertically aligned rollers. The rollers extend inwardly for abutting the inner and outer surfaces of the lip of the track when the slot of the pacer housing is positioned thereon. This allows the pacer housing to glide freely along the lip. Mounted to the top extent of the pacer housing and extended upwardly therefrom is a flag 24. The flag is adapted for identifying the pacer housing and further the runner associated therewith.

As shown in FIG. 5, a drive unit 22 includes a motor situated within the interior space of the top extent of the pacer housing. The motor is rotatably engaged with a drive wheel 25 which is mounted about a horizontal axis. Such engagement is preferably afforded by way of a conventional gear mechanism. The drive wheel depends downwardly from the bottom face of the top extent of the pacer housing thereby abutting the top edge of the lip of the track during use. During use, the motor is adapted to rotate the drive wheel and effect the forward movement thereof along the lip only upon the receipt of a speed signal. It should be understood that a speed of the pacer housing corresponds with that which is transmitted with the speed signal. For example, the voltage associated with the speed signal may be augmented to afford higher speeds.

Figure 4:
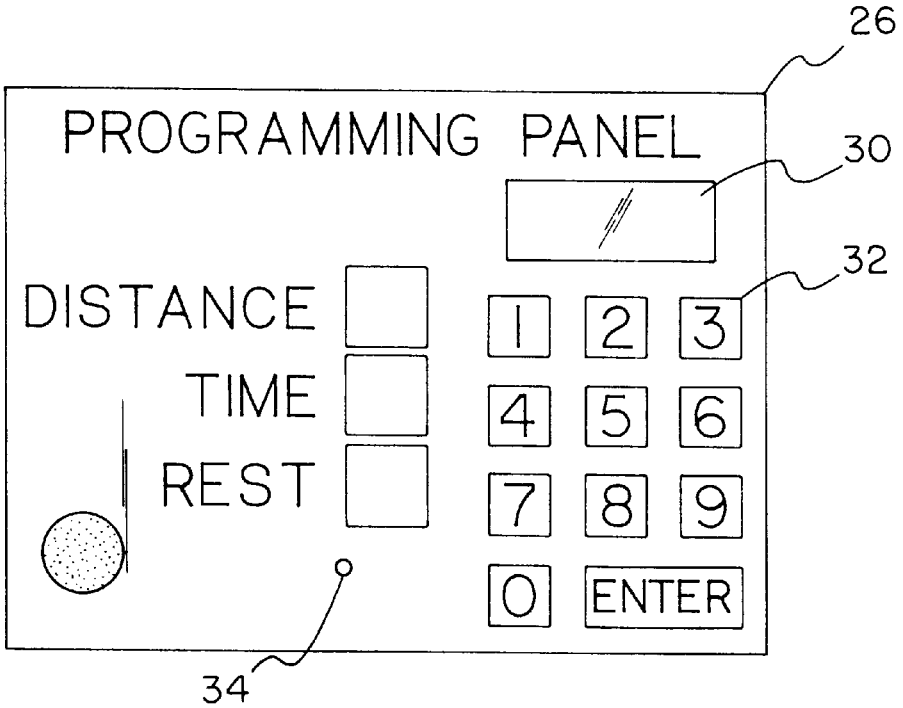
FIG. 4 is a front view of the control panel of the present invention.

As shown in FIGS. 1 & 4, a control panel 26 is positioned on one of the side faces of the top extent of the pacer housing. The control panel includes a transparent lid 28 hingably coupled along a top edge thereof and pivotable between a raised and lowered orientation. The lid thus allows selective access to the control panel.

The control panel further includes a digital display 30 for depicting a number upon the receipt thereof. A numeric keypad 32 includes a plurality of numeric buttons. Associated therewith is a plurality of control buttons 34 including a distance button for allowing a user to enter a number via the numeric keypad representative of a distance. The control buttons further include a time button for allowing a user to enter a number via the numeric keypad representative of a time. A rest button serves to permit a user to enter a number via the numeric keypad representative of a rest period. Lastly, an enter button is included. To accomplish the entering of the foregoing parameters, the appropriate button is depressed whereafter the numeric buttons are depressed. The enter button is then depressed for entering the number.

It should be understood the numbers are displayed on the digital display upon being entered. As shown in FIG. 4, an audio means is included for generating an audio signal only upon the actuation thereof.

Connected to the display, motor, keypad, and buttons is an unillustrated control means. During use, the control means transmits to the motor the speed signal only upon the entering of a distance, a time, and a rest period. Such speed signal represents a speed automatically calculated from the entered distance and time. Further, the speed signal is transmitted only for the duration of the entered time.

Upon the cessation of the speed signal, the control means, in effect, stops the pacer housing for the entered rest period prior to repeating operation and again running at the predetermined speed for the predetermined time period. The control means is further adapted to actuate the audio means a predetermined amount of time prior to the cessation of the rest period. This gives a runner a warning that a rest period is soon over. As an option, more comprehensive work out schedules may be programmed with varying distances, times, and rest period all in subsequent order.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. A new and improved track runner pacing device comprising, in combination:

a running track having a generally oval configuration with an inner periphery and an outer periphery each equipped with an upwardly extending lip of a constant height formed along an entire length thereof, each lip having a top edge and a planar inner and outer surface;

a pacer housing including a top extent having a planar bottom face, a tapered front face, a tapered rear face, and a pair of tapered side faces formed therebetween defining an interior space, the pacer housing further including a bottom extent including a pair of guides integrally coupled to the bottom face of the top extent adjacent to the side faces thereof and extending downwardly therefrom for defining a vertically oriented slot, the side faces each having a planar inner surface with a plurality of free rollers rotatably mounted thereto about vertical axes, wherein the rollers extend inwardly for abutting the inner and outer surfaces of the lip of the track when the slot of the pacer housing is positioned thereon thereby allowing the pacer housing to glide freely along the lip;

a flag mounted to the top extent of the pacer housing and extending upwardly therefrom for identifying the pacer housing;

a drive unit including a motor situated within the interior space of the top extent of the pacer housing, the motor rotatably engaged with a drive wheel which is mounted about a horizontal axis and depends downwardly from the bottom face of the top extent of the pacer housing thereby abutting the top edge of the lip of the track during use, the motor adapted to rotate the drive wheel and effect the forward movement thereof along the lip only upon the receipt of a speed signal, wherein a speed of the pacer housing corresponds with that which is transmitted with the speed signal; and a control panel positioned on one of the side faces of the top extent of the pacer housing, the control panel including a lid hingably coupled along a top edge thereof and pivoting between a raised and lowered orientation for allowing selective access thereto, the control panel further comprising:

a digital display for depicting a number upon the receipt thereof, a numeric keypad including a plurality of numeric buttons, a plurality of control buttons including a distance button for allowing a user to enter a number via the numeric keypad representative of a distance, a time button for allowing a user to enter a number via the numeric keypad representative of a time, and a rest button for allowing a user to enter a number via the numeric keypad representative of a rest period, wherein the numbers are displayed on the digital display upon being entered, audio means for generating an audio signal only upon the actuation thereof, and control means connected to the display, motor, keypad, and buttons, the control means adapted to transmit to the motor the speed signal only upon the entering of a distance, a time, and a rest period, wherein the speed signal represents a speed calculated from the distance and time and is transmitted only for the duration of the entered time at the cessation of which the pacer housing stops for the entered rest period prior to repeating operation, the control means further adapted to actuate the audio means a predetermined amount of time prior to the cessation of the rest period for providing a warning of the same.

* * * * *